US005829325A

United States Patent [19]

Tseng

[11] Patent Number: 5,829,325

[45] Date of Patent: Nov. 3, 1998

[54] SCREWDRIVER

[76] Inventor: Hung-Kui Tseng, 58, Ma Yuan West St., Taichung, Taiwan

[21] Appl. No.: 529,956

[22] Filed: Sep. 18, 1995

[51] Int. Cl.[6] ..... B25B 13/00

[52] U.S. Cl. ..... 81/59.1; 192/49

[58] Field of Search ..... 81/59.1, 60, 63.1; 192/38, 44, 45

[56] References Cited

U.S. PATENT DOCUMENTS 3,908,487 9/1975 Plaw ..... 81/59.1

4,884,478 12/1989 Lieser ..... 81/59.1

*Primary Examiner*—James G. Smith

[57] ABSTRACT

A screwdriver has a socket seat, an inner shaft and an outer shaft. The socket seat has an outer wall, a circular crenulation, a central hole, a circular interspace and enlarged blocks. The inner surface of the circular crenulation has three check recesses between two enlarged blocks. The inner shaft has an upper portion in the socket seat and a lower rod. The upper portion of the inner shaft is checked by the inner surface of the socket seat. A positioning portion which is disposed on the upper portion of the inner shaft has spaced flat surfaces and spaced outcurved surfaces formed on the outer periphery alternately. A radial hole is formed on the positioning portion to receive a steel ball which is suppressed by a spring. The steel ball is disposed in any of the check recesses. Each enlarged block is adjacent to a cylindrical check block. A circular cushion is disposed on the check block. An outer shaft has a rod and a circular flange to seal the circular interspace.

1 Claim, 8 Drawing Sheets

SCREWDRIVER

BACKGROUND OF THE INVENTION

The invnetion relates to a screwdriver. More particularly, the invention relates to a noiseless, fast positioning and stepless adjustable screwdriver.

Referring to FIGS. 7 to 10, a ratchet screwdriver has a hollow main body 40 with an upper opening 41. A shaft 50 is inserted in the main body 40. A ratchet 51 surrounds the middle portion of the ratchet 51. The opening 41 has two side walls 42. Each side wall 42 has two adjacent protrusions 43 and two adjacent slots 44 to receive two checking plates 45, respectively. Each checking plate 45 has a control plate 46 to engage with the ratchet 51. A steering controller 52 has two press legs 53 to stride across two checking plates 45. The steering controller 52 is pushed upward or downward to adjust the checking position of the checking plates 45. If only one of the checking plates 45 is pressed, the seesaw phenomena appears (as shown in FIG. 9). Thus the ratchet 51 can rotate in one direction. If both checking plates 45 are pressed, the ratchet 51 cannot rotate. However, the ratchet screwdriver has some disadvantages. The cooperation between the checking plate 45 and the ratchet 51 will cause noise. If the user is not aware that the screwdriver is in the reverse rotation state, the screw will fall off while the screwdriver rotates in the wrong direction. Further, the user has to hold the screwdriver with one hand and adjust the steering controller 52 with the other hand if the screwdriver is in the reverse rotation state. It is impossible to apply slightly adjusting rotation method for the conventional ratchet screwdriver. As shown in FIG. 10, the idle rotation of the handle 55 must exceed the predetermined angle. If the ratchet screwdriver is applied in a narrow room S, the ratchet screwdriver cannot be idle-rotated. The handle 55 may has a curved rotated arm between the handle 55 and the blade, but it cannot be used in a narrow room S.

SUMMARY OF THE INVENTION

An object of the invention is to provide a screwdriver which can be positioned fast.

Another object of the invention is to provide a screwdriver which can be stepless adjusted slightly.

Another object of the invention is to provide a screwdriver which can be operated noiselessly.

Accordingly, a screwdriver has a socket seat, an inner shaft and an outer shaft. The circular socket seat has an outer periphery wall, a circular crenulation, a central hole defined by the circular crenulation, a circular interspace formed between the outer periphery wall and the circular crenulation, and a plurality of enlarged blocks. The inner surface of the circular crenulation has the first, the second and the third check recesses between two enlarged blocks. The three check recesses form a check unit. Each enlarged block has two incurved side peripheries at two sides of each enlarged block. The inner shaft has an upper portion inserted in the socket seat and a hollow lower rod. The upper portion of the inner shaft is checked by the inner surface of the socket seat. A positioning portion is disposed on the upper portion of the inner shaft. A plurality of spaced flat surfaces and spaced outcurved surfaces are formed on the outer periphery of the positioning portion alternately. A radial hole is formed on the positioning portion to receive a steel ball which is suppressed by a spring. The steel ball is disposed in any of the three check recesses. Each enlarged block is adjacent to a cylindrical check block. A circular cushion is disposed on the check block to supress the check block. An outer shaft has a rod and a circular flange disposed at one end of the rod. The circular interspace is sealed by the circular flange.

DETAILED DESCRIPTION OF THE INVENTION

Figure 1A:
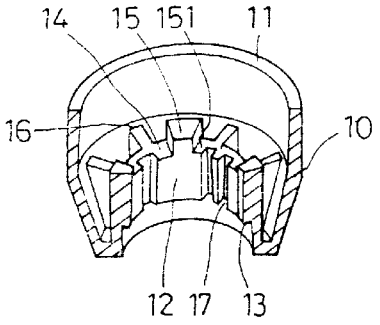
FIG. 1A is a sectional view taken along line lA—lA in FIG. 1.
Figure 1:
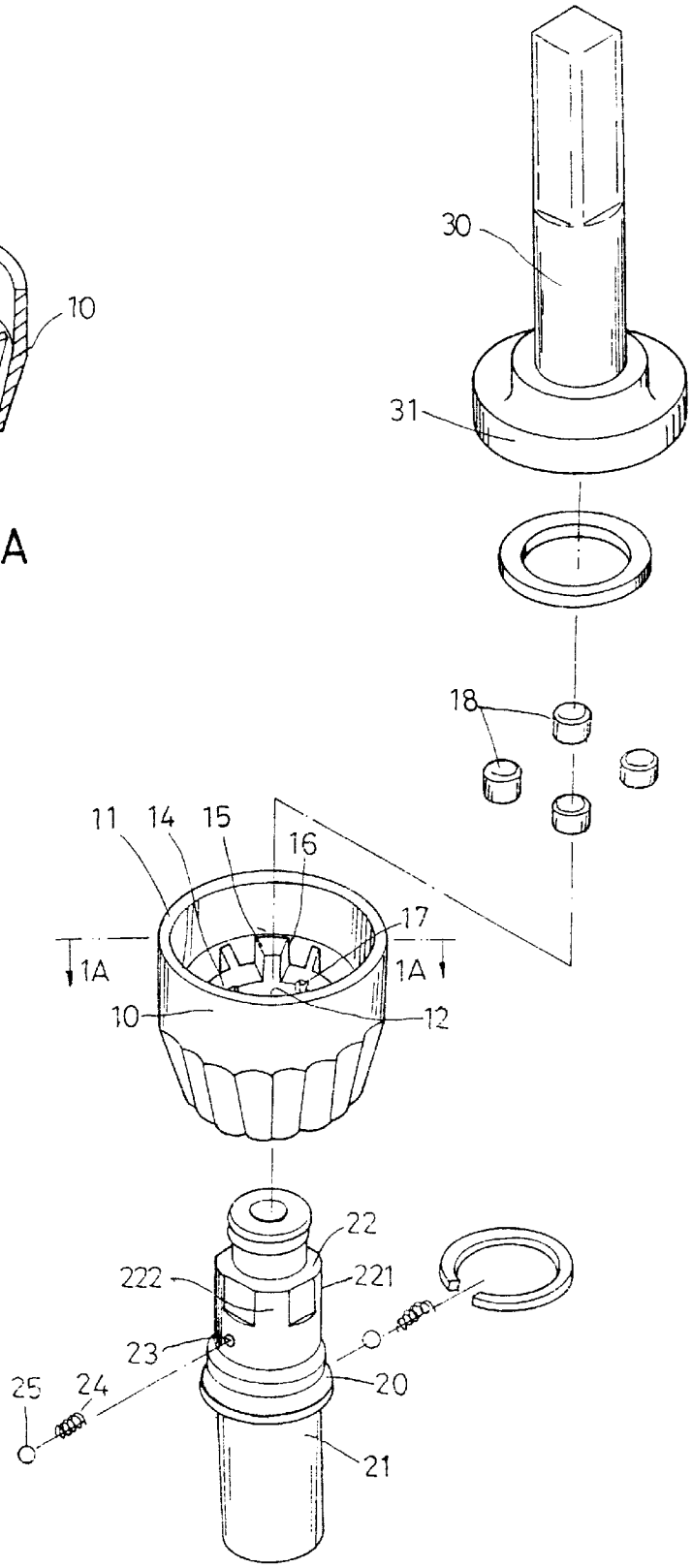
FIG. 1 is a partly perspective exploded view of a screwdriver in accordance with the invention.
Figure 2:
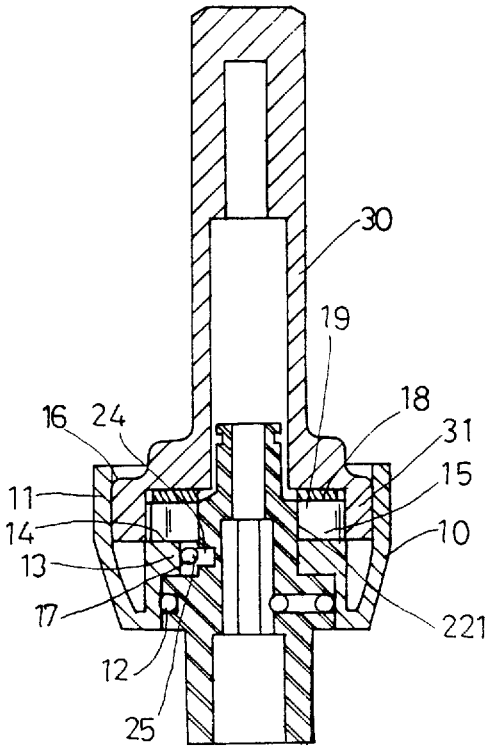
FIG. 2 is an assembly cross-sectional view of FIG. 1.

Referring to FIGS. 1, 1A and 2, a screwdriver has a socket seat 10, an inner shaft 20 and an outer shaft 30. The circular socket seat 10 has an outer periphery wall 11, a circular crenulation 14, a central hole 12 defined by the circular crenulation 14, a circular interspace 16 formed between the outer periphery wall 11 and the circular crenulation 14, and a plurality of enlarged blocks 15 as the teeth of the circular crenulation 14. The inner surface 13 of the circular crenulation 14 has the first, the second and the third check recesses 171, 172 and 173 between two enlarged blocks 15. The three check recesses 171, 172 and 173 form a check unit 17. Each enlarged block 15 has two incurved side peripheries 151 at two sides of each enlarged block 15. The inner shaft 20 has an upper portion inserted in the socket seat 10 and a hollow lower rod 21 receiving a blade. The upper portion of the inner shaft 20 is checked by the inner surface 13 of the socket seat 10. A positioning portion 22 is disposed on the upper portion of the inner shaft 20. A plurality of spaced flat surfaces 221 and spaced out-curved surfaces 222 are formed on the outer periphery of the positioning portion 22 alternately. A radial hole 23 is formed on the positioning portion 22 to receive a steel ball 25 which is suppressed by a spring 24. The number of the flat surfaces 221 correspond to the number of the enlarged blocks 15. The steel ball 25 is disposed in any of the three check recesses 171, 172 or 173. Each enlarged block 15 is adjacent to a cylindrical check block 18. A circular cushion 19 is disposed on the check block 18 in order to supress the check block 18. An outer shaft 30 has a rod and a circular flange 31 disposed at one end of the rod. The circular interspace 16 is sealed by the circular flange 31.

Figure 6:
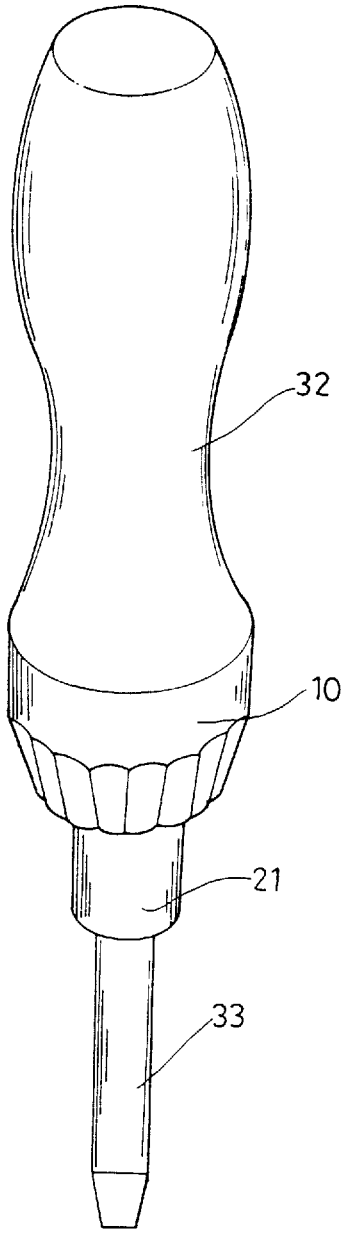
FIG. 6 is a perspective assembly view of a screwdriver.
Figure 7:
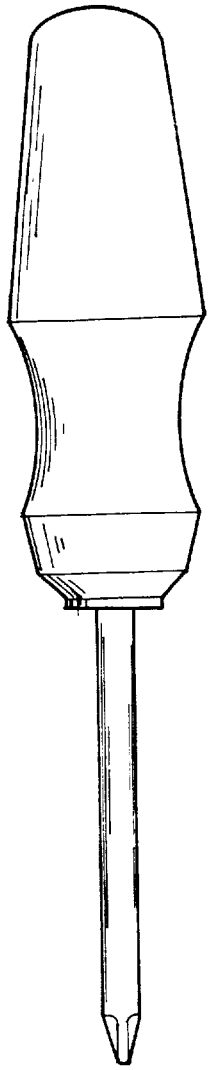
FIG. 7 PRIOR ART
FIG. 7 is a perspective assembly view of a conventional ratchet screwdriver of the prior art.
Figure 8:
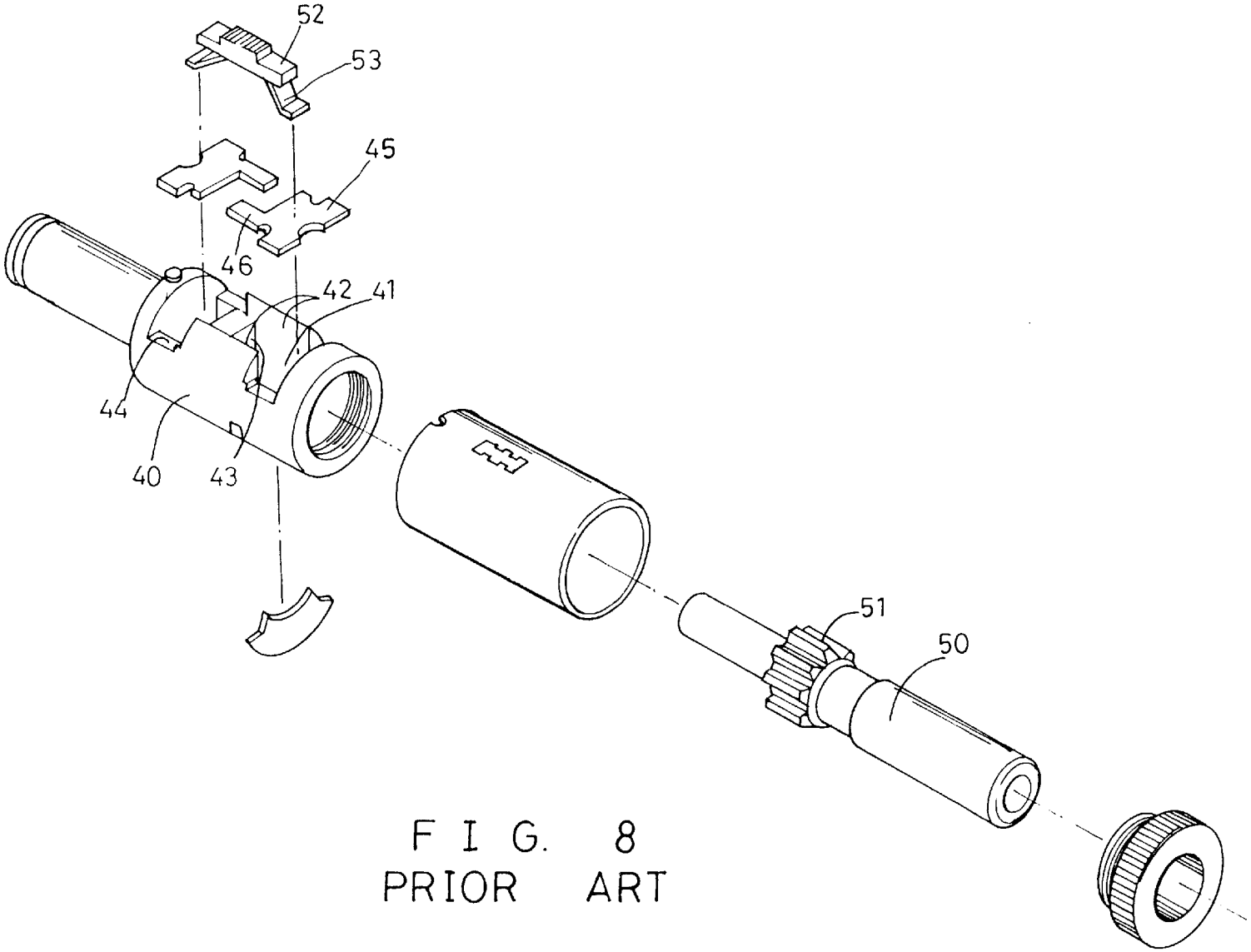
FIG. 8 PRIOR ART
FIG. 8 is a perspective exploded view of FIG. 7.
Figure 9:
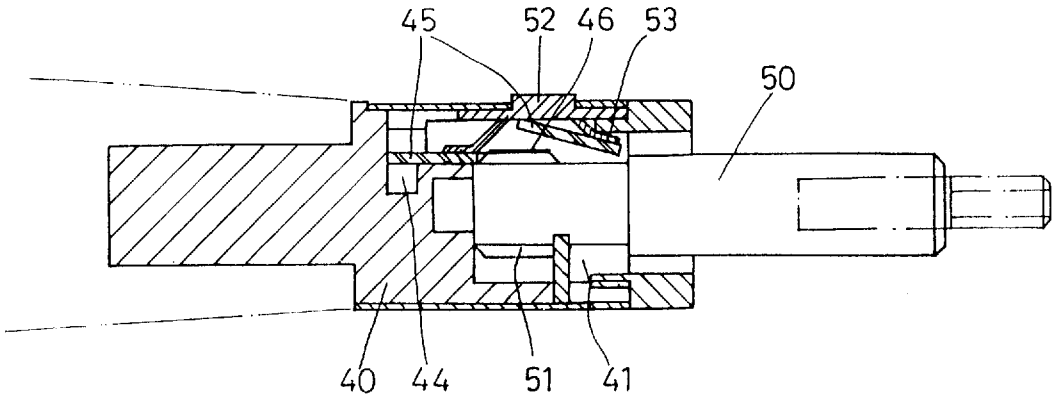
FIG. 9 PRIOR ART
FIG. 9 is a cross-sectional view of FIG. 8.
Figure 10:
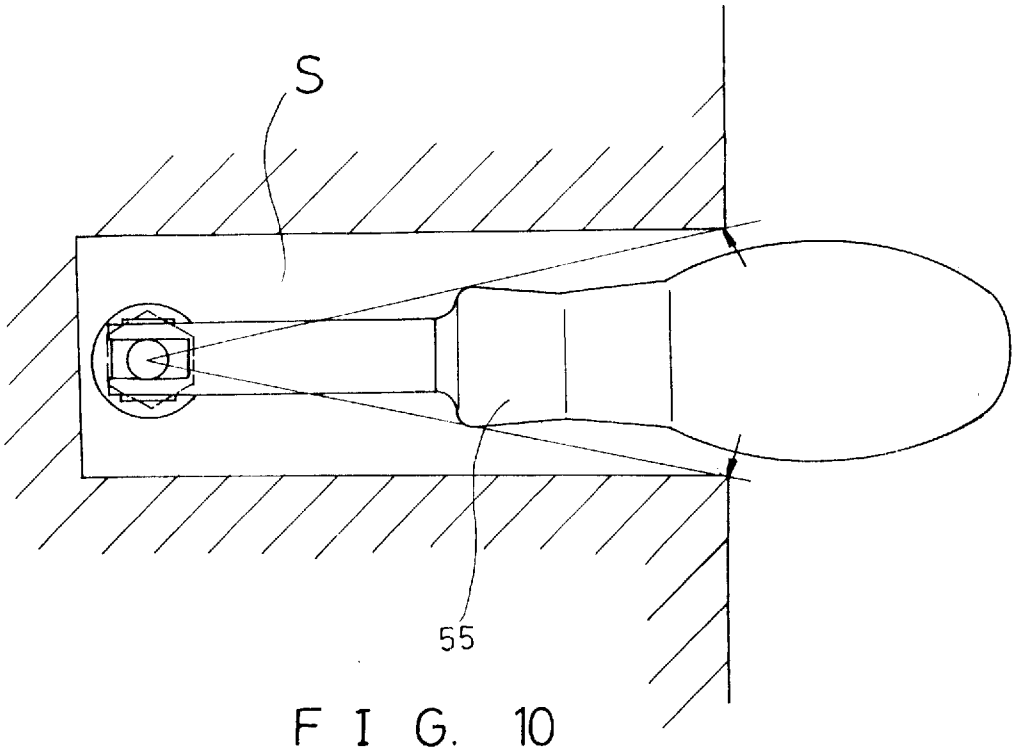
FIG. 10 PRIOR ART
FIG. 10 is a schematic view showing the operation of a conventional ratchet screwdriver of the prior art.

Referring to FIG. 6, a handle 32 encloses the outer shaft 30. The upper edge of the socket seat connects the lower end of the handle 32. The hollow rod 21 receives a blade 33.

Figure 3:
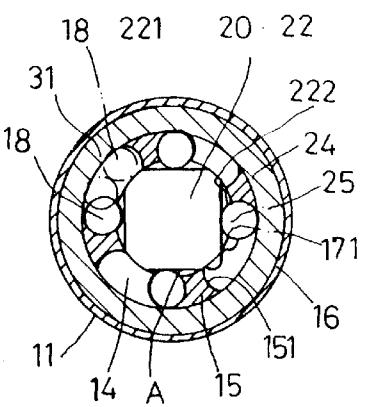

Referring to FIG. 3, the steel ball 25 is positioned in the first check recess 171. The cylindrical check block 18 is always in the position A because of the blocking of the enlarged block 15, while the outer shaft 30 rotates anticlockwisely.

Figure 4:
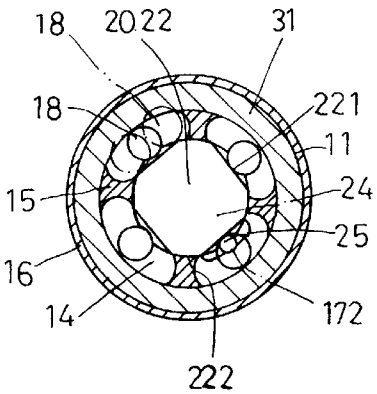

Referring to FIG. 4, the steel ball 25 is positioned in the second check recess 172 while the socket seat 10 is rotated anticlockwisely. Thus the circular flange 31 will not move.

Figure 5:
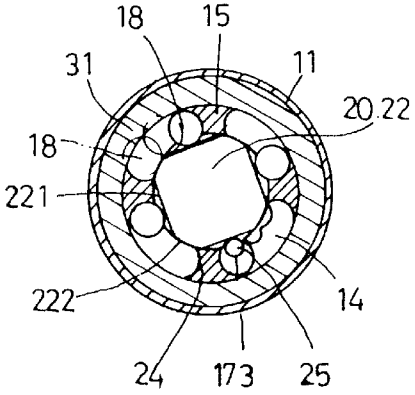
FIGS. 3 to 5 are the schematic views showing the operation of a screwdriver.

Referring to FIG. 5, the steel ball 25 is positioned in the third check recess 173 while the socket seat 10 is rotated anticlockwisely. The cylindrical check block 18 is always in the predetermined position because of the blocking of the enlarged block 15, while the outer shaft 30 rotates clockwisely.

The invention is not limited to the above embodiment but various modification thereof may be made. It will be understood by those skilled in the art that various changes in form and detail may be made without departing from the spirit and scope of the invention.

I claim:

1. A screwdriver comprising:

a circular socket seat having an outer periphery wall, a circular crenulation, a central hole defined by said circular crenulation, a circular interspace formed between said outer periphery wall and said circular crenulation, and a plurality of enlarged blocks;

an inner surface of said circular crenulation having a first, second and third check recesses between two of said enlarged blocks;

each of said enlarged block having two incurved side peripheries at two sides of said enlarged block;

an inner shaft having an upper portion inserted in said socket seat and a hollow lower rod;

said upper portion of said inner shaft checked by said inner surface of said circular crenulation;

a positioning portion disposed on said upper portion of said inner shaft;

a plurality of spaced flat surfaces and spaced outcurved surfaces formed on an outer periphery of said positioning portion alternately;

a radial hole formed on said positioning portion to receive a steel ball which is suppressed by a spring;

said steel ball disposed in any of said three check recesses;

each of said enlarged blocks adjacent to a cylindrical check block;

a circular cushion disposed on said check block to supress said check block.;

an outer shaft having a rod and a circular flange disposed at one end of said rod; and said circular interspace sealed by said circular flange.

* * * * *